United States Patent [19]

Rosman

[11] Patent Number: 4,848,085

[45] Date of Patent: Jul. 18, 1989

[54] OIL-WELL PUMPING SYSTEM OR THE LIKE

[75] Inventor: Alan H. Rosman, Woodland Hills, Calif.

[73] Assignee: Dynamic Hydraulic Systems, Inc., Canoga Park, Calif.

[21] Appl. No.: 159,283

[22] Filed: Feb. 23, 1988

[51] Int. Cl.[4] ..... F16H 39/46

[52] U.S. Cl. ..... 60/372; 60/381; 60/414; 60/418; 60/416; 166/68; 92/161

[58] Field of Search ..... 60/322, 381, 413, 414, 60/417, 418, 416; 166/75.1, 68; 175/202, 203; 92/137, 146, 161; 417/398, 399

[56] References Cited

U.S. PATENT DOCUMENTS

| | | | |
|---|---|---|---|
| 3,058,307 | 10/1962 | Smith | 60/372 |
| 3,782,117 | 1/1974 | James | 60/372 |
| 4,114,375 | 9/1978 | Saruwatari | 60/372 |
| 4,400,141 | 8/1983 | Lee et al. | 60/372 X |
| 4,406,597 | 9/1983 | Stanton | 60/372 X |
| 4,631,918 | 12/1986 | Rosman | 60/414 X |
| 4,707,993 | 11/1987 | Kime | 60/381 X |

*Primary Examiner*—Robert E. Garrett
*Assistant Examiner*—Mark A. Williamson
*Attorney, Agent, or Firm*—Hopgood, Calimafde, Kalil, Blaustein & Judlowe

[57] ABSTRACT

The invention involves pressure-counterweighted oil-well pumping apparatus in which derrick structure of elemental simplicity involves components which are readily assembled and disassembled, such that a given pumping apparatus can be loaded on a single truck and transported from one to the next desired well-pumping location. For a given capacity pumping system, overall height requirements for the derrick structure are less than one half those of U.S. Pat. No. 4,631,918. And power-integrator complexity is substantially reduced by employment of a fixed-displacement variety in conjunction with a variable speed a-c motor as the prime mover, under control of solid-state devices and pressure-sensitive transducer elements which determine upper and lower limits of the reciprocating stroke.

11 Claims, 2 Drawing Sheets

OIL-WELL PUMPING SYSTEM OR THE LIKE

BACKGROUND OF THE INVENTION

The invention relates to hydraulic lift mechanism wherein lift is accomplished through a continuous cyclic succession of vertical reciprocation. And the invention will be particularly described in application to the kind of vertical reciprocation involved in the pumped recovery of oil from a well casing.

My U.S. Pat. No. 4,631,918 describes oil-well pumping apparatus (a) in which a traction cylinder is mounted at the well-head for direct reciprocating operation of the polish rod from which a pumping piston is suspended in a well casing, and (b) in which hydraulic-counterweight principles of my U.S. Pat. No. 4,715,180 are employed to reduce lift-capacity requirements which would otherwise be imposed on the prime mover. In one embodiment, in which a single well is to be pumped, a pressurized hydraulic accumulator is connected to the traction cylinder via a power integrator which is so driven by the prime mover as to shuttle hydraulic fluid under pressure between the accumulator and the traction cylinder, to accomplish the traction-cylinder action necessary to drive the polish rod and its load; in another embodiment, wherein two nearby wells are to be pumped, the hydraulic accumulator is replaced by the traction cylinder for the polish rod assembly of the second well, and the pumping cycle of one well is in phase opposition to that of the other well, such that the minimum loads of the respective traction cylinders offset each other.

The disclosures of said patents are incorporated herein by reference.

The pumping systems of said U.S. Pat. No. 4,631,918 achieve substantial improvement in efficiency and economy of operation, but in the light of the present invention, such efficiency and economy are not as great as I now believe to be possible.

BRIEF DESCRIPTION OF THE INVENTION

It is an object of the present invention to provide an improved oil-well or the like pumping system of the character indicated.

A specific object is to achieve the above object with improved reliability and extended life, through a reduction in the number of mechanically moving components.

Another specific object is to provide improved derrick structure with which such a pumping system may be used.

These objects and further features of the invention are realized in pressure-counterweighted oil-well pumping apparatus in which derrick structure of elemental simplicity involves components which are readily assembled and disassembled, such that a given pumping apparatus can be loaded on a single truck and transported from one to the next desired well-pumping location. For a given capacity pumping system, overall height requirements for the derick structure are less than one half those of said U.S. Pat. No. 4,631,918. And power-integrator complexity is substantially reduced by employment of a fixed-displacement variety in conjunctionwith a variable speed a-c motor as the prime mover, under control of solid-state devices and pressure-sensitive transducer means which determine upper and lower limits of the reciprocating stroke.

DETAILED DESCRIPTION

The invention will be illustratively described in connection with the accompanying drawings, in which.

Figure 1:
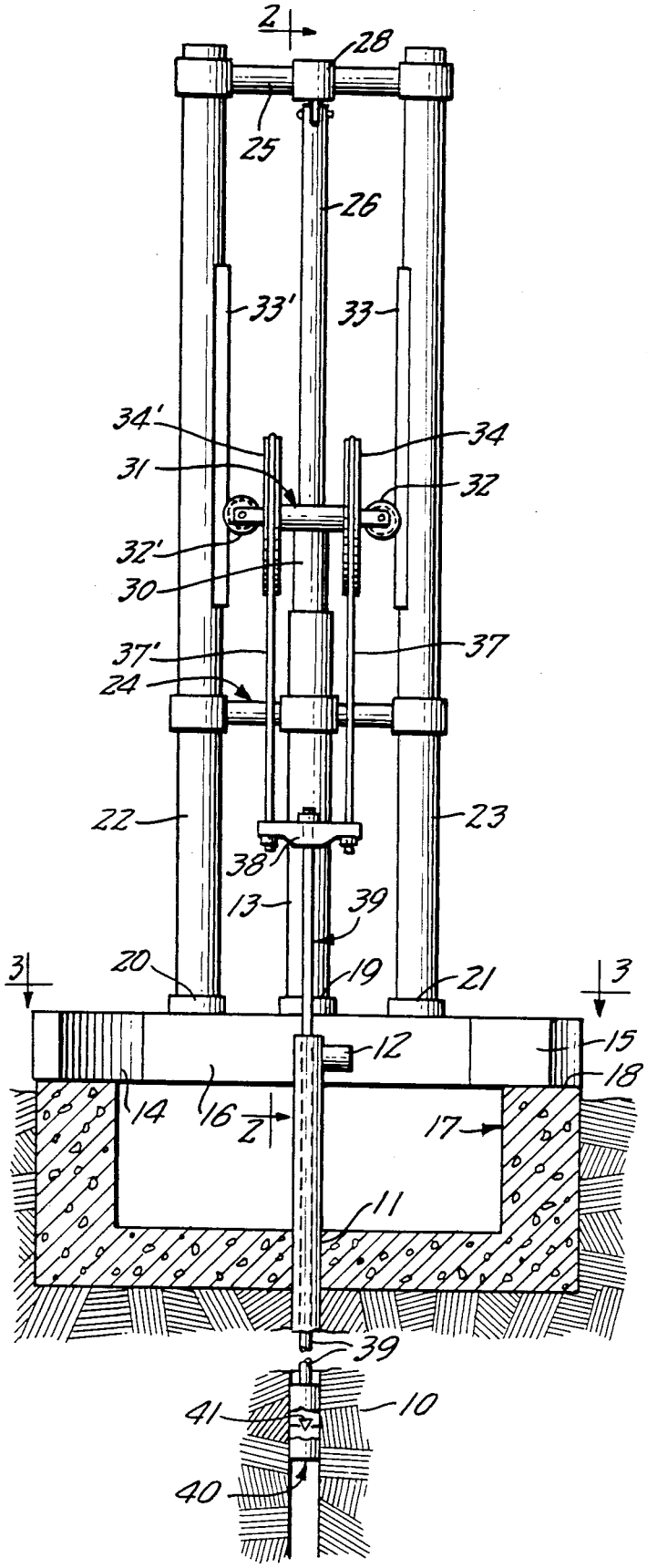
FIG. 1 is a simplified view in front elevation, to illustrate the larger components of oil-well pumping apparatus, in a single-well pumping situation.
Figure 2:
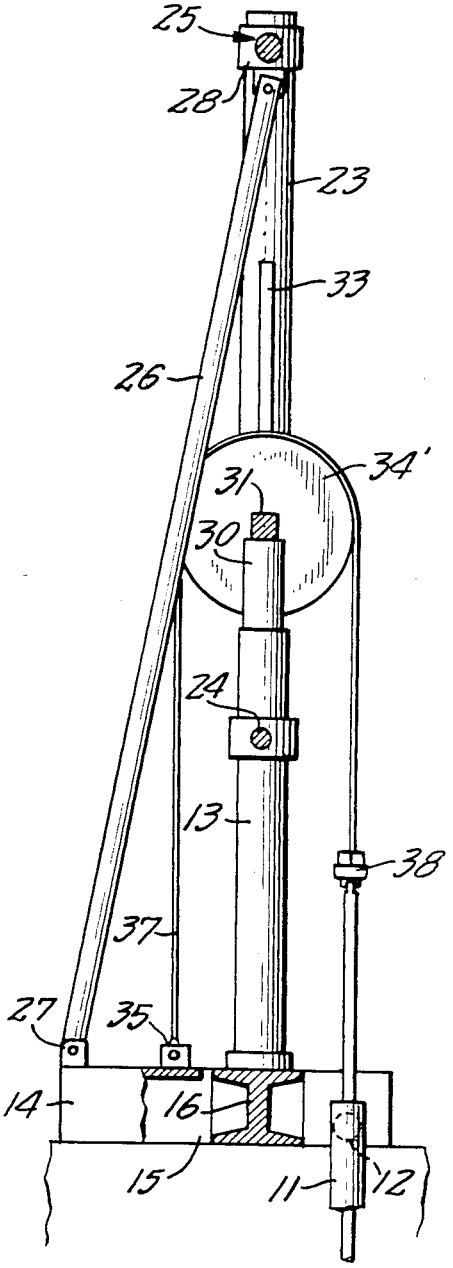
FIG. 2 is a vertical section taken at 2—2 in FIG. 1.
Figure 3:
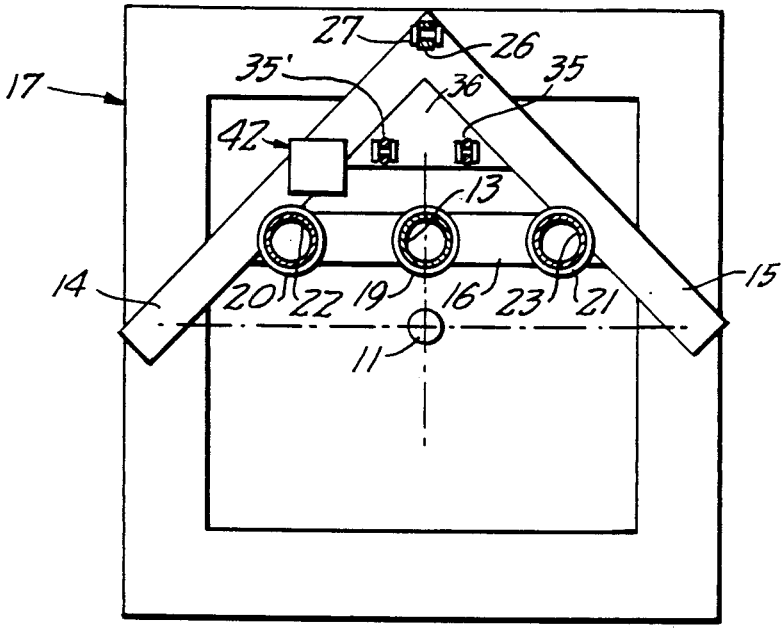
FIG. 3 is a plan view of base structure for the apparatus of FIG. 1, as seen from substantially the plane 3—3 of FIG. 1.

Referring initially to FIGS. 1 to 3, the invention is shown in application to the pumping of oil from a subsurface region 10, via a well casing 11 to a point 12 of delivery at the wellhead. Supporting derrick structure for an upstanding hydraulic cylinder 13 at the wellhead comprises a base frame of connected girder members 14–15–16, wherein members 14–15 are connected at one end to define the right-angled apex of an A-configuration, and wherein member 16 interconnects members 14–15 short of their free ends to thereby establish the bridge of the A-configuration. This base frame is so proportioned as to seat at generally mid-point locations on the upper edges of three walls of the conventional "basement build" 17 around casing 11; typically, the basement build 17 is of concrete, defining a volume that is about 5 ft. square around casing and 6 ft. deep, with the upper edges at or just above ground level. Shims as at 18 enable a level set for the base frame 14–15–16.

The upper surface of the bridging member 16 of the base frame is shown with a central locating means, such as a ring or collar 19 welded to member 16, for telescoped reception and location of the lower closed end of hydraulic cylinder 13, and similar locating devices 20–21 at equal and opposite offset from ring 19 accommodate similar reception and location of the base ends of upstanding tubular derrick frame members 22–23; both ends of the upstanding members 22–23 are closed and their interior volumes are interconnected so that they may serve plural functions, including a hydraulic-accumulator function to be later more fully explained. A first cross-tie yoke 24 assures the parallel and central relation of the upper end of hydraulic cylinder 13 with respect to the upstanding members 22–23, and a second cross-tie yoke 25 provides further such assurance at the upper ends of the upstanding members 22–23. And strictly vertical integrity of members 22–23 is provided by a rigid stay member 26, detachably connected at its lower end to a welded fitment 27 at the apex of the base frame, and detachably connected at its upper end to a central fitment 28 forming part of the upper yoke 25.

The piston element coacting with hydraulic cylinder 13 is preferably a plunger 30 having sealed telescoping fit to the upper open end of cylinder 13. Plunger 30 is of substantially the longitudinal extent of cylinder 13 and is shown projecting to a mere fraction of its extendable length beyond the upper end of cylinder 13. At its upper end, plunger 30 carries crosshead or yoke structure 31 having guide rolls 32–32' at its outer end for stabilized tracking of the upper end of the plunger, by and between parallel guide-rail members 33–33' welded to the respective upstanding tubular frame members 22–23. The crosshead structure 31 also provides rotary-bearing support for two like sheaves 34–34' at equal and opposite offset from the hydraulic-cylinder and its plunger 30. At similar offsets, like anchoring fitments 35–35′ welded to the apex corner of the base frame, at gusset 36, provide like detachable frame-referenced connection for corresponding ends of each of two cables (or chains) 37–37′ which course vertically upward, over the respective sheaves 34–34′, to the point of their shared connection to opposite ends of a yoke member 38. Yoke member 38 will be seen in FIG. 1 to be the means of detachable connection to the upper end of an elongate polish rod assembly 39, from the lower end of which a pumping piston 40 (with its check valve 41) is suspended in casing 11 at a sufficient depth to draw from a subterranean pool or reservoir of oil.

Figure 4:
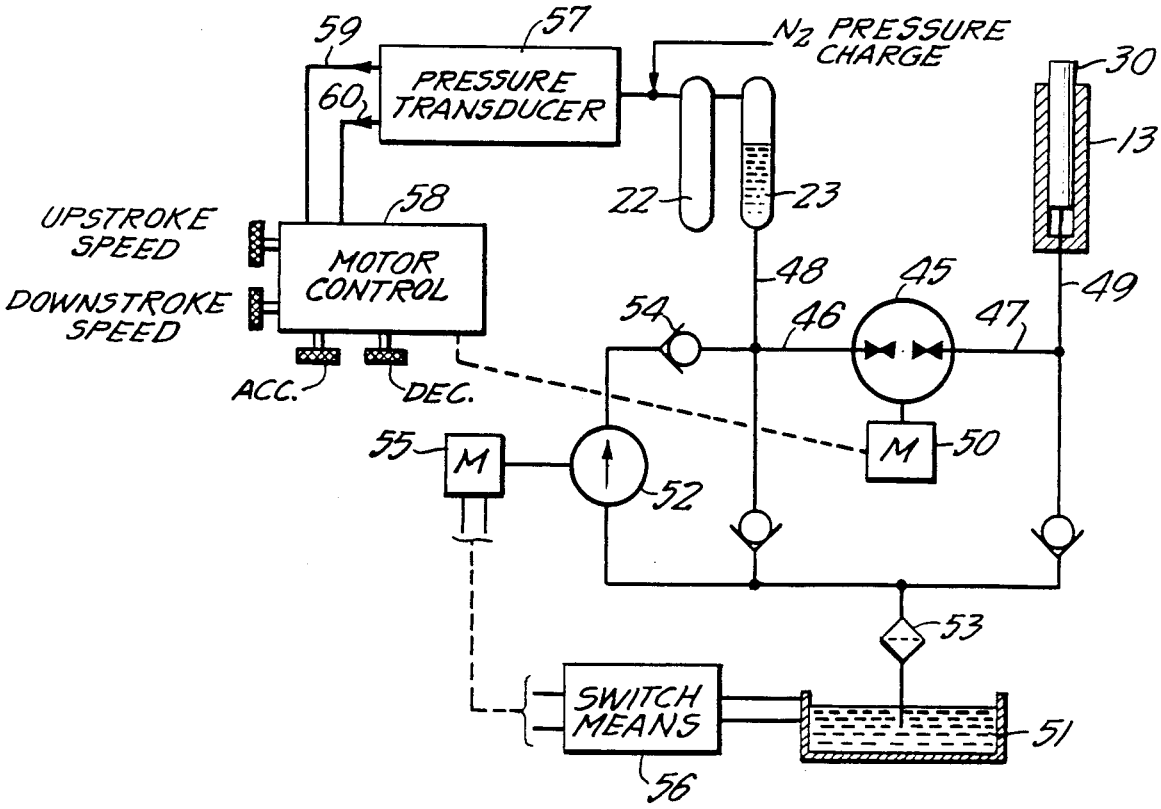
FIG. 4 is a schematic diagram of hydraulic and electrical control circuitry for the pumping apparatus of FIG. 1.

The means for operating plunger 30 is relatively simple and of little bulk, being schematically shown in FIG. 4, and contained in a base-frame mounted housing 42 (FIG. 3) of relatively small volume.

In the hydraulic circuit of FIG. 4, the upper ends of the upstanding tubular members or cylinders 22–23 are seen to be interconnected, and the lower end of cylinder 23 is connected for dispensing and reception of hydraulic fluid. Cylinders 22–23 have closed ends and cooperatively define a hydraulic accumulator wherein the volume available for pressurizing gas (e.g. commercial nitrogen suggested by legend in FIG. 4) very much exceeds the volume of accommodated hydraulic fluid. A power integrator is symbolized at 45 and will be understood to include a rotor between two port connections 46–47; a line 48 connects port 46 with the lower end of accumulator cylinder 23, and a line 49 connects port 47 to the lower or head end of hydraulic cylinder 13. The power integrator is preferably a fixed-displacement pump having a rotor that is reversibly driven by prime mover 50, in the form of a variable speed a-c motor (e.g. with a squirrel-cage rotor).

The system is initially filled with hydraulic fluid to the extent that all hydraulic lines and integrator 45 are filled, and to the extent that, for the "down" limit of plunger 30 displacement, there is at least sufficient hydraulic fluid in accumulator cylinder 23 to account for a full "up" limit of plunger 30 displacement. Remaining gas-filled volume of the accumulator cylinders is substantially in excess of the displacement volume of cylinder 13 and is suitably in the order of at least 10 times this displacement volume. Pressure in line 48 reflects the charged level of pressurizing gas in the accumulator 22/23 and is preferably such that the upward thrusting force of hydraulic pressure beneath plunger 30 at least is sufficient to offset the deadweight loading of the full length of polish rod 39 and its well-pumping piston 40.

The diagram of FIG. 4 does not show, but it will be understood that the described system, particularly at 45, will exhibit some leakage; such leakage will be understood to drain to a sump or reservoir 51, in order to conserve hydraulic fluid. And the volume of hydraulic fluid in the entire described system can be maintained essentially constant by means of a replenishment pump 52 which draws fluid from reservoir 51 (via filter means 53), and supplies the same via a check valve 54 to line 48 on the accumulator side of the system. A separate motor 55 is shown for driving the replenishment pump 52, and motor 55 is operated by relatively close settings of upper and lower limit-switch functions at 56, to assure that the level in reservoir 51 shall at all times be between these upper and lower limit-switch settings.

To complete a description of FIG. 4, a single pressure transducer 57 is shown connected to accumulator 22/23 for response to instantaneous pressure in the accumulator. Transducer 57 is preferably of a variety having an electrical analog output, such that control means 58 for the integrator motor 50 receives a first upper-pressure signal in a first line 59 and a second lower-pressure signal in a second line 60. for the illustrative case of a 10:1 relation between accumulator-gas volume and hydraulic-displacement volume of cylinder 13, the magnitude of accumulator counterbalance is substantially constant but nevertheless subject to a range of 10 percent variation, between (a) an upper-limit pressure when plunger 30 is at the "down" limit of its displacement stroke (meaning that maximum hydraulic fluid has been returned to accumulator cylinder 23) and (b) a lower-limit pressure when plunger 30 is at the "up" limit of its displacement stroke (meaning that maximum hydraulic fluid has been removed from the accumulator in order to advance plunger 30 to the upper extreme of its stroke). It will be understood that it is the ability of transducer means 57 to recognize each of these limiting pressures which enables upper and lower limit signals to be available in lines 59/60 for use by control means 58 in the forward/reverse excitation of the motor 50 which is coupled to the rotor shaft of power integrator 45.

The motor-control means 58 is preferably a solid-state SCR "inverter" device employing power-width modulation. For the case of a 25 hp motor at 50, a Toshiba produce (TOSVERT-130G1) is well suited for the indicated purpose; and, as suggested by descriptive legends in connection with FIG. 4, this particular "inverter" device provides selectively operable settings to control a first speed of motor 50 for the up-stroke displacement of plunger 30, a second (and reversed) speed of motor 50 for the reversed or down-stroke displacement of plunger 30, as well as acceleration/deceleration control at the ends of the respective strokes.

In operation, the polish rod 39 and its suspended well-pumping piston 40 are shuttled in automatically recycling reciprocation, wherein the stroke displacement is twice the displacement of plunger 30. The excitation of motor 50 is controlled by means 58 to effect a relatively slow but essentially constant speed up-stroke wherein acceleration and deceleration are small end fractions of the stroke to minimize mechanical shock. The end fraction of the up-stroke is recognized by transducr 57, to supply in line 60 a low-pressure response signal, whereupon up-stroke deceleration (through motor 50 deceleration) ensues, with motor reversal and down-stroke acceleration to a more rapid constant-speed down-stroke. When transducer 57 recognizes the predetermined upper limit of accumulator pressure, the end of the down-stroke is initiated as a program of motor-50 deceleration and reversal, with initiation of acceleration to the slower steady speed preselected for recycled up-stroke action.

It is to be understood that, at all times throughout the described cycle, accumulator pressure has been operative as a counterweight to balance out and effectively neutralize at least the dead load represented by the polish rod 39 and its connection to the pumping piston 40. If this is the case, then the energy requirements of motor 50 are primarily for the up-stroke phase of the cycle, in that the down-stroke phase is at essentially zero load (from the point of view of motor 50). If, on the other hand, and as preferred, the accumulator pressure is set to balance deadload plus half the load of a well-pumped charge of oil, then motor 50 has a lesser demand for up-stroke added power, and it also has a demand for down-stroke added power; but the demand on motor 50 for power output to the rotor of integrator 45 will be approximately the same for both the forward and reverse phases of drive by motor 50.

A better understanding of the merit of the invention can be derived from consideration of a conventional system as compared with a described system wherein each system has a capacity of pumping 400 barrels of oil per day, from a subsurface depth of 5000 feet. The conventional system is taken as a so-called "walking-beam" system wherein a prime mover motor must angularly oscillate the beam in simple-harmonic cycles of reciprocating the polish rod connected to an end of the beam. For the walking beam to achieve the indicated 400-barrel output from the indicated depth, the prime mover must be of 75-hp capacity, as compared to the indicated 25-hp requirement of the described system of the invention. Further, the relatively short (e.g. 120-inch) strokes of the walking beam are more frequent and with approximately 25-percent well-pumping efficiency, as compared with the less-frequent, essentially constant-speed and longer (e.g. 200-inch) strokes of the system of the invention, which is characterized by approximately 80 percent well-pumping efficiency. The simple-harmonic nature of the conventional beam action means that up-stroke time essentially equals down-stroke time, and that polish-rod speeds are always changing, thus imposing rythmic elastic stretching loads along the full length of polish-rod connection to its well-pumping piston; this fact translates into polish-rod connecting structural strength and weight requirements that are more severe than for the less frequent, slower, constant-speed but longer-stroke action of the system of the invention. As a result, approximately half the polish-rod connection weight can be saved by the system of the invention, and the elastic-stretch phenomenon does not dominate either of the more constant-speed strokes of the presently described cycle.

With respect to the disclosure of my U.S. Pat. No. 4,631,918, the present invention offers advantages of longer and essentially trouble free service by reason of at least the following considerations:

1. There are and need be no mechanical actions or moving parts in control of the hydraulic cycle.

2. The power integrator is the essence of simplicity, involving no adjustable parts and relying solely on motor 50 for forward/reverse and acceleration/deceleration of the integrator rotor in the various phases of the cycle of operation.

3. All electric control functions are achievable with solid-state electronics.

4. Pressure-sensing transducer means to recognize limits of plunger travel eliminate any need for positional limit-switch devices.

5. The derrick structure is readily assembled, disassembled, and transportable.

6. Plunger thrust is in direct reference to positive foundation support.

7. Plunger stroke is one half that of the prior arrangement, for a given system capacity.

What is claimed is:

1. Oil-well derrick apparatus for reciprocating full-stroke actuation of the polish rod of a subsurface pumping piston in an oil-well casing, comprising a rigid unitary base of generally A-shape configuration wherein two outer arm members diverge to outer ends from a connected apex end and a bridge member connects said arm members at corresponding intermediate locations which are at offset from both the apex end and the outer ends of said arm members, an upstanding hydraulic plunger/cylinder centrally and removably mounted to said bridge member with the upper end of its plunger oriented for vertical actuated reciprocation above its cylinder and with a first hydraulic-fluid connection at the lower end of said cyliner, two like upstanding tubular frame members having closed ends and removably mounted to said bridge member in spaced parallel relation and at equal and opposite offsets from said plunger/cylinder, said frame members being of at least twice the elongate extent of said plunger/cylinder, a rigid horizontal cross-connection member detachably connecting the upper ends of said frame members, a gas communicating connection between the upper ends of said frame members and a second hydraulic connection to the lower end of one of said frame members, whereby said frame members may provide a hydraulic accumulator/counterweight function, further rigid horizontal cross-connection means at an upper elevation of the cylinder of said plunger-cylinder and rigidly connecting said cylinder to the respective frame members, a rigid stay member detachably connecting said cross-connection member to the apex-end region of said base, a crosshead carried at the upper end of said plunger between the respective frame members and having stabilizing guidance coaction with said frame members, two like sheaves mounted to said crosshead for rotation on a horizontal axis and at equal and opposite offsets from said plunger/cylinder, two lengths of cabling having yoked means of polish-rod connection at one end and coursing the respective sheaves with the other ends of said lengths anchored to said base, a power integrator having a first port connected to said first hydraulic-fluid connection and a second port connected to said second hydraulic-fluid connection, said power integrator including reversibly rotatable means for determining the direction and quantum of hydraulic-fluid displacement between said ports and therefore between said plunger/cylinder and said one tubular frame frame member, a reversible electric motor connected to drive said reversibly rotatable means, a volume of hydraulic fluid contained by said one tubular frame member and said plunger/cylinder and said power integrator and its port connections, said volume exceeding the displacement volume of said plunger/cylinder and being but a relatively small fraction of the combined volume of said tubular frame members, means for supplying gas under pressure to the remainder of said combined volume, the supplied gas pressure being sufficient to so counter-balance the gravitational load on said plunger that the load on said motor is substantially the same for both upstroke and downstroke displacement of said plunger, and control means for said motor including pressure-transducer means responsive to predetermined upper and lower limits of pressure on the accumulator/counterweight side of said integrator for determining stroke-reversing directions of hydraulic-fluid displacement via said power integrator.

2. The apparatus of claim 1, in which said stay member is detachably connected to said base and to said cross-connection member.

3. The apparatus of claim 1, in which said lengths of cabling are lengths of chain.

4. The apparatus of claim 1, in which elongate guide means on each of said upstanding tubular frame members has guiding engagement with the respective ends of the crosshead at the upper end of said plunger.

5. Apparatus according to claim 4, in which each of said guide means is a rail on one of said upstanding tubular guide members, and in which rollers at the respective crosshead ends have tracking engagement with said rails.

6. The apparatus of claim 1, in which the level of supplied gas pressure is sufficient to additionally counter-balance substantially one half the gravitational load of pumped oil lifted in an upstroke displacement of said plunger, whereby electric-motor power consumption is at substantially a single relatively low level for both downstroke and upstroke phases of plunger operation.

7. Oil-well derrick apparatus for reciprocating full-stroke actuation of the polish rod of a subsurface piston in an oil-well casing, comprising an upstanding plunger/cylinder having a base-mounting lower end and having a single hydraulic fluid connection at said lower end, stabilizing structure for the upper end of said plunger/cylinder and including two rigidly spaced parallel upstanding tubular frame members closed at both ends and having a gas connection between their upper ends, said tubular frame members being symmetrically positioned on diametrically opposite sides of said plunger/cylinder, a hydraulic-fluid connection at the lower end of one of said tubular frame members, a power integrator having a first port connection to the lower-end connection of said one tubular frame member and a second port connection to the lower-end connection of said plunger/cylinder, said power integrator including reversibly rotatable means for determining the direction and quantum of hydraulic-fluid displacement between said ports, a reversible electric motor connected to drive said reversibly rotatable means, a volume of hydraulic fluid contained by said one tubular frame member and said plunger/cylinder and said power integrator and its port connections, said volume exceeding the displacement volume of said plunger/cylinder and being but a relatively small fraction of the combined volume of said tubular frame members, and control means for said motor including pressure-transducer means responsive to predetermined upper and lower limits of pressure on the accumulator/counterweight said of said integrator for determining stroke-reversing directions of hydraulic-fluid displacment via said power integrator.

8. The apparatus of claim 7, including a sump reservoir for accumulation of hydraulic fluid leakage from said power integrator, and pump means having a supply connection to said reservoir and a check-valve protected delivery connection to the accumulator side of said power integrator, said pump means having on/off control in accordance with detection of predetermined upper and lower limits of reservoir level, whereby to maintain essentially constant the volume of accumulator-pressurized hydraulic fluid.

9. The apparatus of claim 7, in which said control means includes a solid-state SCR inverter employing power-width modulation, said control means having means for separately selecting upstroke speed and downstroke speed, with provision of acceleration and deceleration control of motor speed at the respective pressure-sensed ends of the strokes.

10. The apparatus of claim 7, in which said reversible electric motor is of squirrel-cage variety.

11. Apparatus according to claim 7, in which said power integrator is a fixed-displacement pump.

* * * * *